US009528301B2

(12) United States Patent
Bendel et al.

(10) Patent No.: US 9,528,301 B2
(45) Date of Patent: Dec. 27, 2016

(54) MOTOR VEHICLE DOOR LOCK

(75) Inventors: Thorsten Bendel, Oberhausen (DE); Claus Töpfer, Sindelfingen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 532 days.

(21) Appl. No.: 13/984,603

(22) PCT Filed: Feb. 8, 2012

(86) PCT No.: PCT/DE2012/000117

§ 371 (c)(1),
(2), (4) Date: Jan. 22, 2014

(87) PCT Pub. No.: WO2012/107026

PCT Pub. Date: Aug. 16, 2012

(65) Prior Publication Data

US 2014/0132008 A1 May 15, 2014

(30) Foreign Application Priority Data

Feb. 9, 2011 (DE) ..... 10 2011 010 815

(51) Int. Cl.
*E05C 3/06* (2006.01)
*E05B 65/10* (2006.01)
(Continued)

(52) U.S. Cl.
CPC ..... *E05B 65/10* (2013.01); *E05B 77/06* (2013.01); *E05B 85/26* (2013.01); *Y10S 292/22* (2013.01);
(Continued)

(58) Field of Classification Search
CPC .... E05B 77/06; E05B 85/26; Y10T 292/1047; Y10S 292/22
(Continued)

(56) References Cited

U.S. PATENT DOCUMENTS 4,382,622 A * 5/1983 Ishikawa ..... E05B 77/12 292/216
5,188,406 A * 2/1993 Sterzenbach ..... E05B 85/26 292/210
(Continued)

FOREIGN PATENT DOCUMENTS

DE 197 19 999 A1 11/1998
DE 199 02 561 A1 8/2000
(Continued)

OTHER PUBLICATIONS

International Search Report for corresponding patent application No. PCT/DE2012/000117 dated Aug. 22, 2012.
(Continued)

*Primary Examiner* — Kristina Fulton
*Assistant Examiner* — Christine M Mills
(74) *Attorney, Agent, or Firm* — Renner, Otto, Boisselle & Sklar, LLP

(57) ABSTRACT

The invention relates to a motor vehicle door lock equipped with a locking mechanism (1, 2, 3), an actuation lever unit (6, 7) acting on the locking mechanism (1, 2, 3), and a catch lever (12). The catch lever (12) blocks the locking mechanism (1, 2, 3) at least when acceleration forces of a given magnitude occur, e.g. in case of an accident (crash), rendering the locking mechanism ineffective. According to the invention, the catch lever (12) acts upon a pawl (3) of the locking mechanism (1, 2, 3) in the direction of the blocking position of the pawl during normal operation and in the event of a crash while allowing the pawl (3) and thus the locking mechanism (1, 2, 3) to be in the releasing position only during normal opening operation.

12 Claims, 1 Drawing Sheet

(51) Int. Cl.
*E05B 77/06* (2014.01)
*E05B 85/26* (2014.01)

(52) U.S. Cl.
CPC ..... *Y10T 292/0908* (2015.04); *Y10T 292/1047* (2015.04)

(58) Field of Classification Search
USPC ..... 292/216, DIG. 23, DIG. 22
See application file for complete search history.

(56) References Cited

U.S. PATENT DOCUMENTS

| | | | | |
|---|---|---|---|---|
| 5,865,481 | A * | 2/1999 | Buschmann | E05B 77/06 292/169.11 |
| 2009/0322105 | A1* | 12/2009 | Lee | E05B 77/06 292/237 |
| 2010/0052336 | A1* | 3/2010 | Bendel | E05B 85/26 292/196 |

FOREIGN PATENT DOCUMENTS

| | | | | |
|---|---|---|---|---|
| DE | 199 10 513 | A1 | 9/2000 | |
| DE | 20 2006 012091 | U1 | 12/2007 | |
| DE | 102008028256 | A1 * | 12/2009 | E05B 81/14 |
| DE | 102009026921 | A1 * | 12/2010 | E05B 81/20 |
| EP | 1884611 | A2 | 2/2008 | |
| WO | 2009/150225 | A2 | 12/2009 | |

OTHER PUBLICATIONS

Written Opinion for corresponding patent application No. PCT/DE2012/000117.

* cited by examiner

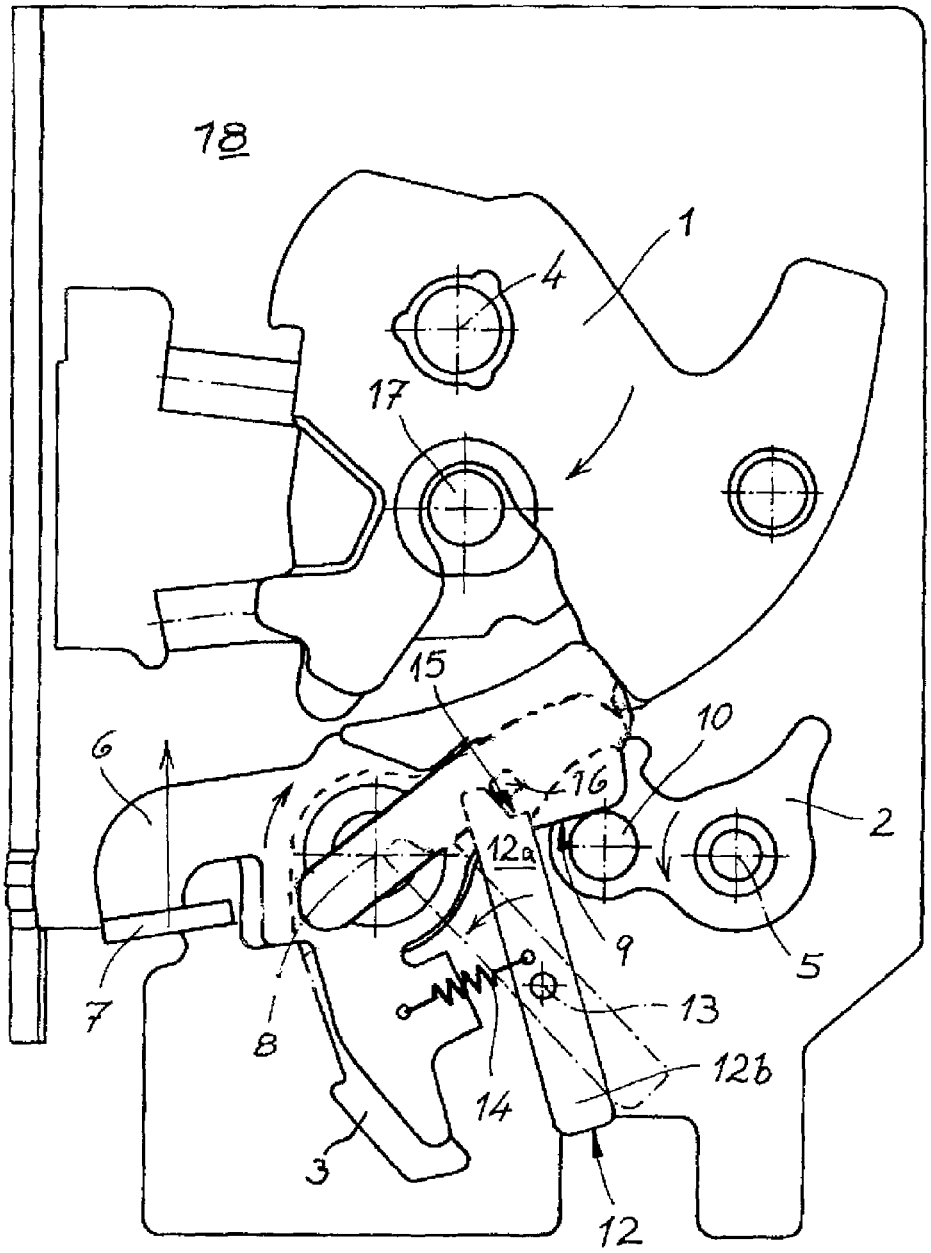
18
1
4
17
15
10
6
16
2
12a
9
5
7
8
13
12b
14
3
12

MOTOR VEHICLE DOOR LOCK

This application is a national phase of International Application No.

PCT/DE2012/000117 filed Feb 8, 2012and claims priority to DE 10 2011 010 815.7 filed Feb. 9, 2011.

The invention relates to a motor vehicle door lock with a locking mechanism, an actuation lever unit with a release lever acting on the locking mechanism and a catch lever, blocking the locking mechanism at least when acceleration forces of a given magnitude occur, e.g. in case of an accident (crash).

The actuation lever unit generally comprises one or several levers. Normally, the unit contains at least an internal actuating lever, an external actuating lever and a release lever. In addition, the actuation lever unit also often contains a coupling lever. When the actuation lever unit is acted upon, the locking mechanism can be opened in this way. For this purpose, the release lever typically engages with a pawl of the locking mechanism and lifts it off an associated rotary latch. The rotary latch then opens with the assistance of a spring and releases an engaged locking bolt. As a result, an associated motor vehicle door can be opened.

In case of an accident or in the event of a crash, as mentioned above, high acceleration forces generally occur, which can be several times greater than the earth's acceleration. The respective motor vehicle door lock is thus exposed to considerable inertia forces which could cause an unintentional opening of the locking mechanism and thus of the entire associated door lock.

These described scenarios represent considerable hazards for vehicle users. A motor vehicle door opened unintentionally can, for instance, no longer provide any safety devices contained therein, such as a side airbag or side impact protection for the protection of the passengers of the vehicle. For this reason, various measures were already implemented in the past that either block the actuation lever unit or the locking mechanism during the occurrence of the described abnormal acceleration forces, e.g. in the event of a crash. In these cases, a so-called inertia lock is used, which is in its rest position under normal operating conditions and is not engaged in the actuation lever unit or the locking mechanism.

A catch lever acting on the actuation lever unit is, for instance, disclosed in DE 197 19 999 A1. The lock or catch lever blocks an opening lever when the described acceleration forces are exerted in case of an accident. For this purpose, the lock or the catch lever and the opening lever are arranged transversely to the swivel direction of the opening lever and are displaceable in relation to each other. In case of a relative displacement caused by increased acceleration forces, the opening lever enters the lock. This aims to prevent unwanted opening in the event of a crash whilst keeping the design simple. A permanent blocking of the opening lever is also generally discussed.

The generic state of the art of DE 19910 513 A1 describes a crash catch on a door lock. This catch contains a pivotable catch lever, which can be pivoted by inertia force around its swivel axis into a blocking position stopping the transmission element. Also, a counter blocking surface is provided, which is fixed in position.

Not all aspects of the prior art are satisfactory. The systems generally work in that the catch lever blocks the actuation lever unit or locking mechanism only during the occurrence of abnormal acceleration forces, e.g. in the event of a crash. In practical application this can result in incorrect functioning, for instance, in case that the movement of the catch lever is blocked or delayed due to corrosion or ageing, etc. Such functional faults can also not be checked, for instance, as part of maintenance, as the catch lever has to be moved, which is not possible in practical application. The invention aims to remedy this situation.

The invention is based on the technical problem of further developing such a motor vehicle door lock in such a way that functional reliability is increased, whilst keeping the design simple.

To solve this technical problem, a generic motor vehicle door lock of the invention is characterised in that the catch lever in undisplaced standard operation and in the event of a crash acts upon a pawl for the locking mechanism in the direction of the blocking position (and thus also in the blocking position of the locking mechanism) and only permits the releasing position of the pawl and thus of the locking mechanism in the displaced standard operation.

As part of the invention, normal operation refers to the functional states of the motor vehicle door lock in which only acceleration forces occur that correspond to the normal driving dynamics processes.

In contrast, accidents are in most cases associated with greater accelerations and delays. In this case, reference is made below to abnormal acceleration processes or abnormal acceleration forces or the event of a crash or accident.

If such an accident or crash occurs, the catch lever—in contrast to the state of the art—remains active, e.g. permanently active, as the catch lever is in its blocking position in its unactivated state and during standard operation as well as in the event of a crash. In this functional position the catch lever acts upon the pawl for the locking mechanism in the direction of the blocking position. In other words, the catch lever, the pawl and thus also the locking mechanism assume the blocking position during normal operation and in the event of a crash.

The catch lever permits the releasing position of the pawl and thus of the locking mechanism only during opening in the standard operation, with the catch lever, the pawl and thus the locking mechanism being in their respective releasing position.

During the unactivated state in normal operation, a release lever of the actuation lever unit also does not act on the locking mechanism in an opening manner but rests in this respect. The release lever does thus not act on a pawl of the locking mechanism consisting of a rotary latch and pawl in the opening sense. In comparison to the locking mechanism, the actuation lever unit rests. In contrast, part of the opening in the normal operation includes that the release lever is deflected in order to deflect a blocking pawl and lift the pawl off the rotary latch. The rotary latch is consequently released from the pawl and can move to its open position with the assistance of a spring. A previously retained locking bolt is released again. As the locking bolt is typically connected to a motor vehicle door, the motor vehicle door is also released during this process.

During standard operation and in the event of a crash, the catch lever as a whole is permanently active in its blocking position. The catch lever ensures, after all, that the pawl remains in its blocking position. In this blocking position the pawl retains or fixes the locking mechanism. To achieve this, the pawl can engage with the rotary latch and fix it in its fully closed position or closed position. In the event of a crash, the inertia moment of the catch lever ensures that the lever does not follow any movement of the actuation lever unit and can also not follow it, irrespective of the direction of the crash.

If, however, the actuation lever unit is acted upon during normal operation, the catch lever is deflected. This deflection of the catch lever moves the blocking pawl and pawl into its release position. The release position of the pawl corresponds with the rotary latch being released from the pawl and thus releases the locking mechanism. The previously engaged rotary latch is released as during this process, the pawl is also lifted off the rotary latch. This means that each opening process for the locking mechanism corresponds as part of the invention to an actuation of the catch lever, which is moved from its blocking position into the releasing position. Similarly, this applies to the blocking pawl and, of course, the pawl. As a result, each normal actuating and triggering process causes the catch lever to be moved. Any corrosion, sticking, etc., as in the state of the art, can thus not occur. The result is greater functional reliability combined with a simpler design.

In an advantageous embodiment, the catch lever is designed as a swivel lever rotatable around an axis. Typically, the catch lever is accommodated in a lock case together with a locking mechanism. It has also proven to be advantageous for the catch lever to be designed as a two arm lever consisting of a blocking arm and a compensation arm.

Preferably, the blocking arm engages with the rotary latch in such a way that the rotary latch can be released for opening.

Generally, the catch lever is coupled to the release lever of the actuation lever unit. An elastic coupling has proven to be particularly advantageous as in this case and, in particular, in case of a crash, the catch lever can remain at rest whilst any movements of the actuation lever unit are permitted. Such movements of the actuation lever unit are, however, not transferred to the catch lever or to the locking mechanism blocked by it.

In detail, the catch lever and the release lever are connected with each other by at least one spring. The spring can engage with the blocking arm of the catch lever. To open the locking mechanism, the release lever is acted upon in such a way that it activates the blocking pawl and lifts the pawl off the closed rotary latch. During this process, the release lever acts at the same time on the catch lever elastically coupled with said lever by means of the spring. In order for the catch lever to be able to release the pawl during this process, the catch lever may contain a blocking shape, a cam, a deformation, etc., interacting with the pawl. At the same time, the play between the catch lever and the pawl is dimensioned in such a way that the described process can easily occur.

This means that the catch lever interacts advantageously with the pawl. The pawl itself engages with the rotary latch of the locking mechanism. For this purpose, the pawl can be arranged on the actuation lever unit. The pawl is, in particular, mounted below the release lever.

As soon as the locking mechanism or the rotary latch moves into its closed state by the locking bolt moving into the rotary latch, the pawl does not only engage in the arrangement of the invention but the blocking pawl also moves into its blocking position. To achieve this, the blocking pawl can engage with an edge of the rotary latch. Any movement of the actuation lever unit does thus not result in an opening of the locking mechanism until the blocking pawl is lifted from the pawl.

As part of the invention, the pawl interacts with the catch lever, which is mounted on the release lever. Only when the catch lever assumes its releasing position, can the pawl be disengaged from the locking mechanism and the rotary latch is released with the pawl lifted off.

It has shown to be advantageous for the axes of the catch lever, release lever, blocking pawl and pawl to be arranged together in the lock case. In most cases the aforementioned axes are arranged in parallel to each other. This also applies to an axis passing through or accommodating the rotary latch.

The moment of inertia of the catch lever is designed in such a way that even in the event of a crash and the abnormal acceleration forces created during such an event, hardly any relative movement of the catch lever occurs. The rotary latch and the catch lever do thus remain at rest even in such a case, so that this also applies to the locking mechanism as a whole. Unintentional opening of the locking mechanism is thus excluded.

Also, the design is in most cases such that the inertia forces of the catch lever created during a crash exceed more or less easily any coupling forces to the actuation lever unit. As already explained, the catch lever is advantageously elastically coupled with the release lever via said spring. In case of a crash or accident, the inertia forces acting on the catch lever are significantly greater than any tensile forces created by the coupling spring which are, e.g. transferred by the deflected release lever onto the catch lever.

The catch lever is returned by a second spring, moving it into its blocking position.

Considering the fact that the catch lever and the blocking pawl are actuated during every normal opening process, a particularly reliable functioning is provided by a simple design.

These are the main advantages of the invention.

Below, the invention is explained in more detail with reference to only one embodiment. The only FIGURE is a schematic diagram of the motor vehicle door lock of the invention.

The FIGURE shows a motor vehicle door lock, containing a locking mechanism 1, 2, 3 consisting of a rotary latch 1, a blocking pawl 2 and a pawl 3. The locking mechanism 1, 2, 3 is arranged in a lock case 18. For this purpose the rotary latch 1 has a corresponding axis 4 and the locking pawl 2 also contains its own axis 5.

The general arrangement also includes an actuation lever unit 6, 7, consisting of a release lever 6 and a further or several further levers 7 connected thereto. In order to open the locking mechanism 1, 2, 3 from its closed state, the release lever 6 must be rotated clockwise around its axis 8 by the actuation lever unit 6, 7. Such a rotation of the release lever 6 causes the release lever 6 to engage with one of its edges 9 in a journal 10 of the blocking pawl 2. The clockwise movement of the release lever 6 during this process corresponds with the blocking pawl 2 carrying out a counter clockwise movement around its axis 5.

As a result, the blocking pawl 2 releases the pawl 3 and said pawl releases the previously engaged rotary latch 1. The spring moves the rotary latch 1 from the closed position shown in the FIGURE by turning it clockwise into an open position and releases at the same time a previously engaged locking bolt 17. The locking bolt 17 is connected to a motor vehicle door, not shown, which is also released during this operation and can be opened.

Apart from the blocking pawl 2, the pawl 3 ensures that the locking mechanism 1, 2, 3 is being retained in the closed position. The blocking pawl 2 functions thus—if you will—as an additional safeguard of the rotary latch 1, in addition to the pawl 3.

According to the invention, the movement of the pawl 3 from the blocking position to the releasing position (and back) is produced with the aid of a release lever 6, during which a catch lever 12 is moved from its blocking position into a releasing position. The catch lever 12 is thus a swivel lever 12 rotatable around an axis 13. The catch lever is actually designed as a two-arm lever and contains a blocking arm 12*a* and a compensation arm 12*b*. The blocking arm 12*a* interacts with the pawl 3 already acted upon.

The catch lever 12 and its axis 13 are accommodated in the lock case 18 together with the locking mechanism 1, 2, 3. The same applies to the release lever 6 and its axis 8. At the same time, the respective axes 4, 5, 8 and 13 of, on one hand, the rotary latch 1 and the blocking pawl 2 and, on the other hand, the pawl 3 and the release lever 6 as well as ultimately the catch lever 12, are always arranged parallel to each other. All axes 4, 5, 8, 13 extend mainly perpendicularly from a base plane of the lock case 18 and are all anchored in the lock case 18.

It is apparent that the catch lever 12 is coupled to the actuation lever unit 6, 7 by means of an elastic coupling in form of a spring 14. For this purpose, the spring 14 in the embodiment connects the release lever to the catch lever 12 by the spring 14 engaging the blocking arm 12*a* of the catch lever 12.

The catch lever 12 contains a cam or a deformation 15 interacting with the counter element 16 on the pawl 3. In the embodiment, the catch lever 12 contains a recess 15 on its blocking arm 12*a*. A cam 16 arranged on the pawl 3 engages in this recess.

The pawl 3 is indeed mounted below the release lever 6.

To change the blocking position of the pawl 3 to the releasing position, the catch lever 12 must only carry out an indicated counter-clockwise turn around its axis 13. The catch lever 12 then assumes its releasing position shown as a dashed line. This counter-clockwise movement of the catch lever 12 around its axis 13 is caused by the release lever 6 being turned clockwise around its axis 8 in normal operation to open the locking mechanism 1, 2, 3. To achieve this, the actuation lever unit 6, 7 can be acted upon accordingly by a door handle, e.g. an internal door handle or external door handle being pulled. This is indicated by an arrow.

The acting on the actuation lever unit 6, 7 causes a deflection of the actuation lever unit 6, 7 and thus the deflected normal operation of the catch lever 12. Due to the coupling of the catch lever 12 to the release lever 6 by means of the spring 14, the catch lever 12 is carried along during the clockwise rotation of the release lever 6 around its axis 8, as shown in the illustration. Accordingly, the recess 15 on the blocking arm 12*a* of the blocking lever 12 moves into its left end position. As a result, the catch lever 12 releases the pawl 3.

As the described process and the clockwise rotation of the release lever 6 act at the same time on the journal 10 of the blocking pawl 2 with the aid of the stop edge 9, the blocking pawl 2 is synchronously activated and the pawl 3 is automatically or by means of a further contour on the release lever 6 lifted off the rotary latch 1. At the end of this process, the rotary latch 1 has been released and can move from the closed position in the FIGURE clockwise around its axis 4 and can release the previously engaged locking bolt 17.

If the actuation lever unit 6, 7 and thus the catch lever 12 is not deflected, the catch lever 12 remains in its blocking position and ensures that the pawl 3 for the locking mechanism 1, 2, 3 is also being acted upon in the direction of its blocking position. This means that the catch lever 12 remains at rest and consequently also the pawl 3 interacting with the catch lever 12, with both levers retaining their blocking position unchanged, thus retaining the rotary latch 1 in a closed condition. This position of the normal operation is also maintained in the event of a crash. The inertia moment of the catch lever 12 ensures that no relative movement of the catch lever 12 occurs in case of a crash, so that the two catch levers and pawl 3 remain at rest in relation to each other.

This even applies in the event that the actuation lever unit 6, 7 is deflected due to applied acceleration forces. As such, a deflection is expressly permitted by the elastic coupling between the actuation lever unit 6, 7 and the catch lever 12. This is ensured by the spring 14 arranged between the release lever 6 and the catch lever 12. As already stated above, the design of the example is thus that any coupling forces between the actuation lever unit 6, 7 and the catch lever 12 produced and applied by the spring 14 are significantly weaker than the inertia forces acting on the catch lever 12. In other words, even in case of a deflection of the release lever 6, the spring 14 is not able to deflect the catch lever 12, remaining in position due to its inertia moment.

In another embodiment, not shown, the catch lever 12 acts in the described way on the pawl 3 of a locking mechanism 1, 3 not containing a blocking pawl 2, with the release lever acting directly on the pawl 3.

The invention claimed is:

1. Motor vehicle door lock comprising a locking mechanism equipped with a rotary latch and a pawl that blocks the rotary latch in a blocking position, an actuation lever unit acting on the locking mechanism by moving the pawl out of the blocking position during a normal opening operation, and a catch lever operable for blocking the locking mechanism when acceleration forces of a given magnitude occur during a crash, wherein during a normal non-actuated operation corresponding to the blocking position of the pawl and in the event of a crash, the catch lever is in a non-deflected position and the catch lever acts against the pawl of the locking mechanism in the direction of the blocking position, wherein when the actuation lever unit is acted upon during the normal opening operation, the catch lever is moved to a deflected position and allows the pawl and the locking mechanism to be in a releasing position, and wherein an inertia moment of the catch lever does not allow any relative movement of the catch lever in the event of a crash, wherein inertia forces of the catch lever occurring during a crash exceed coupling forces that couple the catch lever to the actuation lever unit.

2. Motor vehicle door lock according to claim 1, wherein the catch lever is a straight swivel lever pivotable around a central axis.

3. Motor vehicle door lock according to claim 1, wherein the catch lever is housed in a lock case together with the locking mechanism.

4. Motor vehicle door lock according to claim 1, wherein the catch lever is designed as a two-arm lever with a blocking arm and a compensation arm, wherein the blocking arm acts against the pawl during the normal non-actuated operation and in the event of a crash.

5. Motor vehicle door lock according to claim 1, wherein the catch lever is coupled to the actuation lever unit.

6. Motor vehicle door lock according to claim 5, wherein the catch lever is coupled to the actuation lever unit via an elastic coupling.

7. Motor vehicle door lock according to claim 1, wherein the catch lever interacts with a release lever of the actuation lever unit.

8. Motor vehicle door lock according to claim 7, wherein the pawl is arranged below the actuation lever unit and the release lever.

9. Motor vehicle door lock according to claim 1, wherein the catch lever contains a locking contour, a cam, or a deformation interacting with the pawl.

10. Motor vehicle door lock according to claim 1, wherein the catch lever interacts with the pawl, which in turn engages in a rotary latch of the locking mechanism.

11. Motor vehicle door lock comprising a locking mechanism equipped with a rotary latch and a pawl that blocks the rotary latch in a blocking position, an actuation lever unit acting on the locking mechanism by moving the pawl out of the blocking position during a normal opening operation, and a catch lever operable for blocking the locking mechanism when acceleration forces of a given magnitude occur during a crash, wherein during a normal non-actuated operation corresponding to the blocking position of the pawl and in the event of a crash, the catch lever is in a non-deflected position and the catch lever acts against the pawl of the locking mechanism in the direction of the blocking position, wherein when the actuation lever unit is acted upon during the normal opening operation, the catch lever is moved to a deflected position and allows the pawl and the locking mechanism to be in a releasing position, and wherein an inertia moment of the catch lever does not allow any relative movement of the catch lever in the event of a crash, wherein the catch lever is coupled to the actuation lever unit, and wherein the catch lever and the actuation lever unit are connected to each other by at least one spring.

12. Motor vehicle door lock according to claim 11, wherein the spring engages with a blocking arm of the catch lever.

* * * * *